United States Patent [19]

Hunt, III et al.

[11] Patent Number: 4,655,525

[45] Date of Patent: Apr. 7, 1987

[54] MEANS FOR RETAINING TERMINALS IN A CONNECTOR

[75] Inventors: Alexander Hunt, III, Harrisburg; Dennis E. Smith, Hershey, both of Pa.

[73] Assignee: AMP Incorporated, Harrisburg, Pa.

[21] Appl. No.: 752,327

[22] Filed: Jul. 3, 1985

[51] Int. Cl.[4] ..... H01R 11/11

[52] U.S. Cl. ..... 339/63 M; 339/59 M; 339/196 M; 339/217 S

[58] Field of Search ..... 339/59 R, 59 M, 60 R, 339/60 M, 63 R, 63 M, 206 R, 206 P, 217 S, 217 PS, 196 M

[56] References Cited

U.S. PATENT DOCUMENTS

| | | | |
|---|---|---|---|
| 3,487,355 | 12/1969 | Cairns | 339/176 |
| 3,601,760 | 8/1971 | Cairns | 339/59 |
| 4,066,325 | 1/1978 | Pearce, Jr. et al. | 339/176 MP |
| 4,443,048 | 4/1984 | Moist, Jr. | 339/63 M |
| 4,544,220 | 10/1985 | Aiello et al. | 339/59 M |
| 4,565,416 | 1/1986 | Rudy et al. | 339/59 M |

FOREIGN PATENT DOCUMENTS

| | | |
|---|---|---|
| 57-192076 | 12/1982 | Japan . |
| 3686084 | 10/1984 | Japan . |

*Primary Examiner*—Gil Weidenfeld

*Assistant Examiner*—Paula A. Austin

*Attorney, Agent, or Firm*—Anton P. Ness

[57] ABSTRACT

An insert member is insertable into a rearward section of an electrical connector and securable therewithin, securing terminals therein. Terminal-engaging stop shoulders at a front end of the insert are disposed against and behind stop shoulders on the terminals disposed in respective terminal cavities in the connector, terminated on ends of conductors. Channels in the insert member pair with channels in the housing walls to substantially contain each conductor therealong. The insert member can have lateral latches thereon to latch in recesses in the housing. The terminal cavities can be arranged in rows, and each row has an insert-receiving cavity in the rearward section of the housing which contains the conductors and is in axial communication with the terminal cavities and a lateral wall extends between the insert-receiving cavities. A particular structure of an insert member for such an arrangement comprises a rear transverse section and side sections extending forwardly which are disposed one along each side of the lateral wall and in a respective insert-receiving cavity when the insert member is inserted, thus securing two adjacent rows of terminals in the housing. Stop shoulders thereon during insertion will engage any partially inserted terminals to push them forwardly into a fully seated position.

17 Claims, 8 Drawing Figures

MEANS FOR RETAINING TERMINALS IN A CONNECTOR

FIELD OF THE INVENTION

This invention relates to the field of electrical connectors, and more particularly to dielectric housings having electrical contact terminals secured in cavities therein for mating engagement with a corresponding housing containing mating terminals.

BACKGROUND OF THE INVENTION

Various means are known to secure terminals inside of cavities of a housing. These include the use of potting compound, spring clips and the like. Especially in a multiterminal housing it is important that all terminals be held securely and in accurate alignment during assembly and handling of the housing and during mating with a corresponding housing which may involve significant insertion force, to maintain the precise alignment of many terminals with their counterpart terminals. Such concerns are also important during in-service use of the housing and during disengagement of one housing from the other when a terminal therein may be subjected to tensile force or tugging and possibly become dislodged from or loosened within its cavity.

U.S. Pat. No. 4,066,325 discloses a lock plate insertable into a connector housing's rear slot adjacent an associate row of terminated conductors secured in the housing. Each lock plate latchably secures to the housing and secures the stamped and formed channel-shaped terminals of that row in their respective passageways forwardly of the lock plate, by means of engaging perpendicular tabs of each terminal. Two such plates can secure two rows of terminals in the housing. The lock plate is said to move any partially seated terminals to a fully seated position, during insertion of the lock plate into the housing.

Japanese Utility Model Publication No. 36860/84 discloses a plate-shaped spacer insertable into a housing adjacent a row of terminated conductors, and having forwardly extending portions each associated with a respective terminal. Each such portion has a projection extending toward a respective terminal and engaging therebehind, securing the respective terminals in respective housing cavities when the spacer is latchingly secured in the housing.

U.S. Pat. No. 3,487,355 discloses one method which involves, in a housing having two rows of several cavities containing terminals therein, inserting a long, thin rectangular member from a side of the housing and between the two rows of terminals such that the side edges of the insert member project into recesses on the terminals to hold them in place. U.S. Pat. No. 3,601,760 discloses mating plug and female housings, each with two rows of cavities containing terminals, which cavities have flexible walls with locating tabs which enter annular recesses of the terminals to position and hold the terminals, and a long, thin rectangular member is then inserted from a side of the housing assembly into an opening between the cavities to prevent free flexing of the walls while it locks the plug and female housings and the pin and socket terminals together.

It is desirable to have, in addition to a securing means, a secondary means to assure that the terminals remain properly secured within their respective cavities after assembly, during handling and in-service use. It is also desirable to do this in a way which permits disassembly for removal and replacement of terminals, for instance. Further, it is desirable to do this in an economical manner. It is also desirable to provide a means to provide terminal position assurance, that is, a means to actively position a terminal properly within its cavity by moving it axially forwardly until it is seated or latchably secured therein.

It is still further desirable to have a single means which secures two rows of terminals in place simultaneously and also provides terminal position assurance therefor.

SUMMARY OF THE INVENTION

According to the present invention, a multiterminal connector housing has terminal-receiving cavities having terminal-latching means such as ledges on resilient fingers or expandable walls along the cavity. When a terminal is inserted into its cavity, a pair of circumferential stop shoulders of the terminal define a latching seat which is latchingly engaged by terminal-latching ledges to latchingly secure the terminal therein.

According to the present invention, a locking insert is provided to be removably inserted into an open area in the rearward section of the housing between the terminal-receiving cavities and alongside the conductors, which insert has a cross-sectional shape conforming closely to the cross-sectional shape of the open area.

The locking insert has terminal-engaging shoulders along terminal-proximate sides thereof which engage respective terminals rearwardly of stop shoulders of the terminals. When this locking insert is latched or secured in place in the housing, the shoulders of the locking insert prevent axially rearward movement of the terminals.

The preferred embodiment of locking insert is capable of engaging a terminal not fully inserted, and urging it forwardly into place, thus providing terminal position assurance.

The preferred embodiment of the locking insert of the present invention can provide secondary locking of two adjacent rows of terminals simultaneously in a housing, which housing provides a lateral wall between the two rows of terminals. A plurality of such locking inserts can thus secure four or more rows of terminals in an appropriate housing.

According to still another aspect of the present invention, the locking insert may have lateral latching members to latch into latching slots in said connector housing when said locking insert has been fully inserted into a locking position. Such latching members may be disengaged when desired for easy removal of said locking insert in order to then remove one or more contact terminals from said housing.

DETAILED DESCRIPTION OF THE PREFERRED EMBODIMENT

Figure 1:
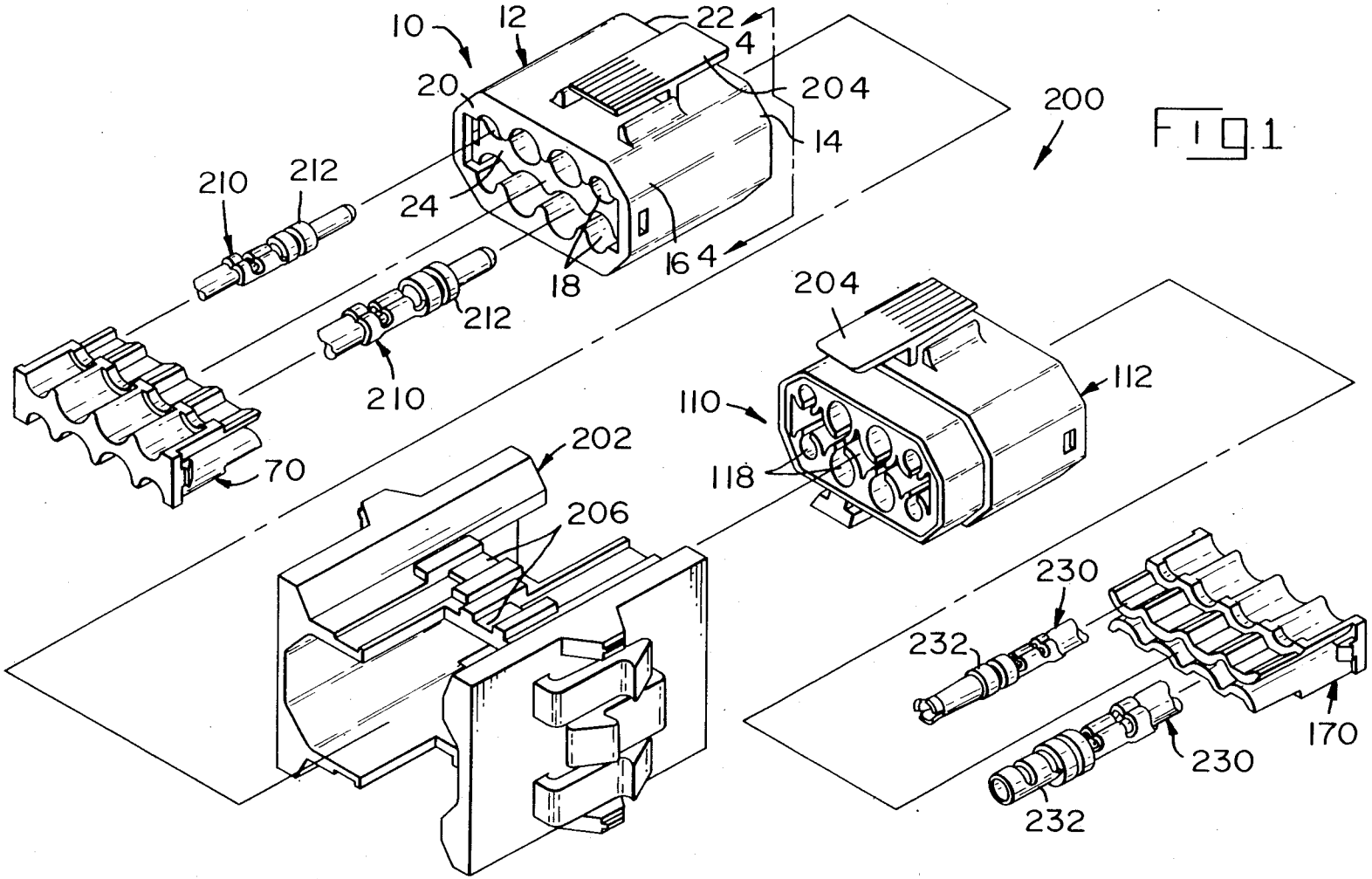
FIG. 1 is an exploded perspective view of the assembly of mating connectors with one embodiment of the locking insert means of the present invention.
Figure 2:
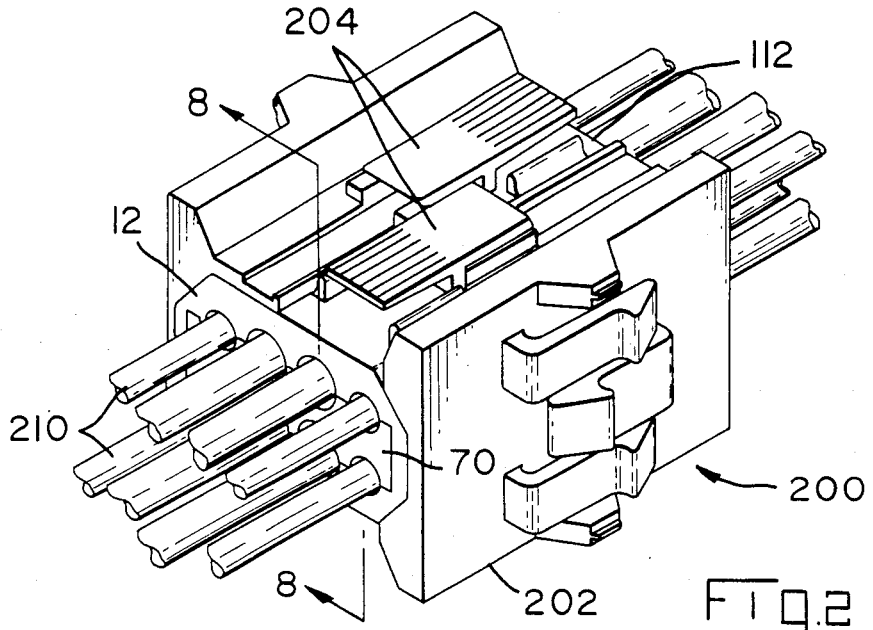
FIG. 2 is an assembly view of the assembly of FIG. 1.

FIG. 1 illustrates an assembly 200 of mating connectors 10, 110 wherein a preferred embodiment of the invention is used. Pin connector assembly 10 contains two rows of pin-terminated conductors therein and socket connector assembly 110 has two rows of socket-terminated conductors therein. Connectors 10 and 110 are matable and latchably securable within latching shell member 202 by means of latches 204 on connectors 10, 110 engaging latching means 206 on shell member 202. Shell member 202 may be mounted to a frame, support or panel (not shown) and either connector 10 or 110 may be removed therefrom by manually disengaging the repsective latch 204. Connector 10 comprises a dielectric housing 12 having generally a forward section 14 and a rearward section 16 and terminal-receiving cavities 18 extending axially therewithin in axial communication with rear surface 20 and front surface 22; terminated conductors 210 have pin terminals 212 terminated to forward end portions thereof latchably secured in respective cavities 18; and a locking insert member 70 is securable within rearward housing section 16. Similarly, connector 110 comprises a dielectric housing 112, conductors 230 having socket terminals 232 terminated thereto and secured in cavities 118, and a locking insert 170. Socket terminals 232 are electrically matable with pin terminals 212, and housing 112 is matable with housing 12. FIG. 2 illustrates the fully assembled connector assembly 200 of FIG. 1. Housings 10 and 110, shell member 202 and locking inserts 70, 170 are made of suitable resilient dielectric material such as unfilled thermoplastic polyester, VALOX 357 resin (trademark of General Electric Company).

Figure 3:
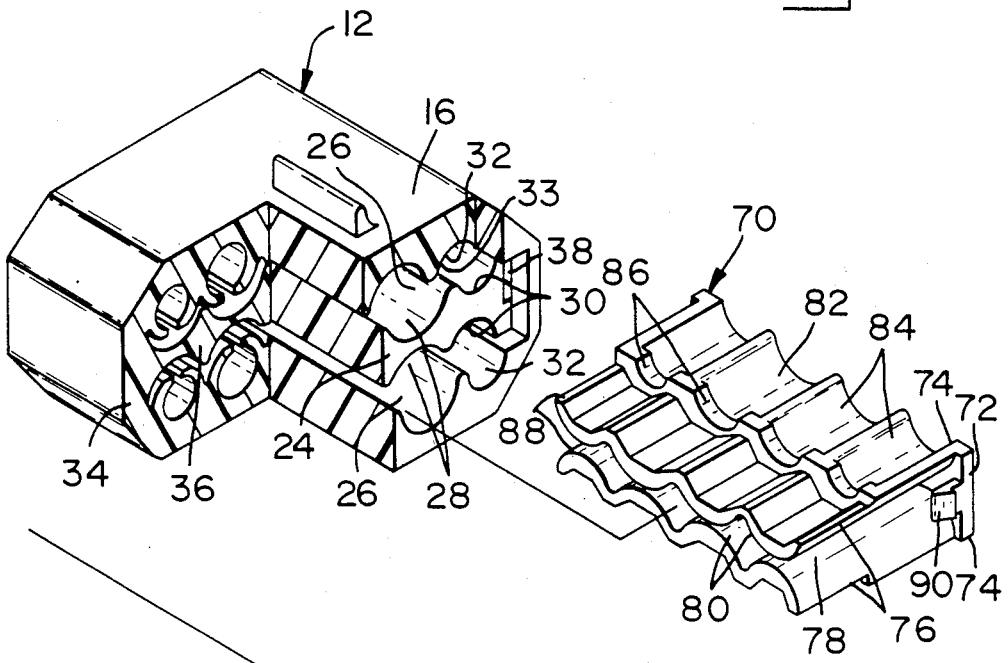
FIG. 3 is a perspective view of a rearward housing section and a forward end of a corresponding locking insert member.
Figure 4:
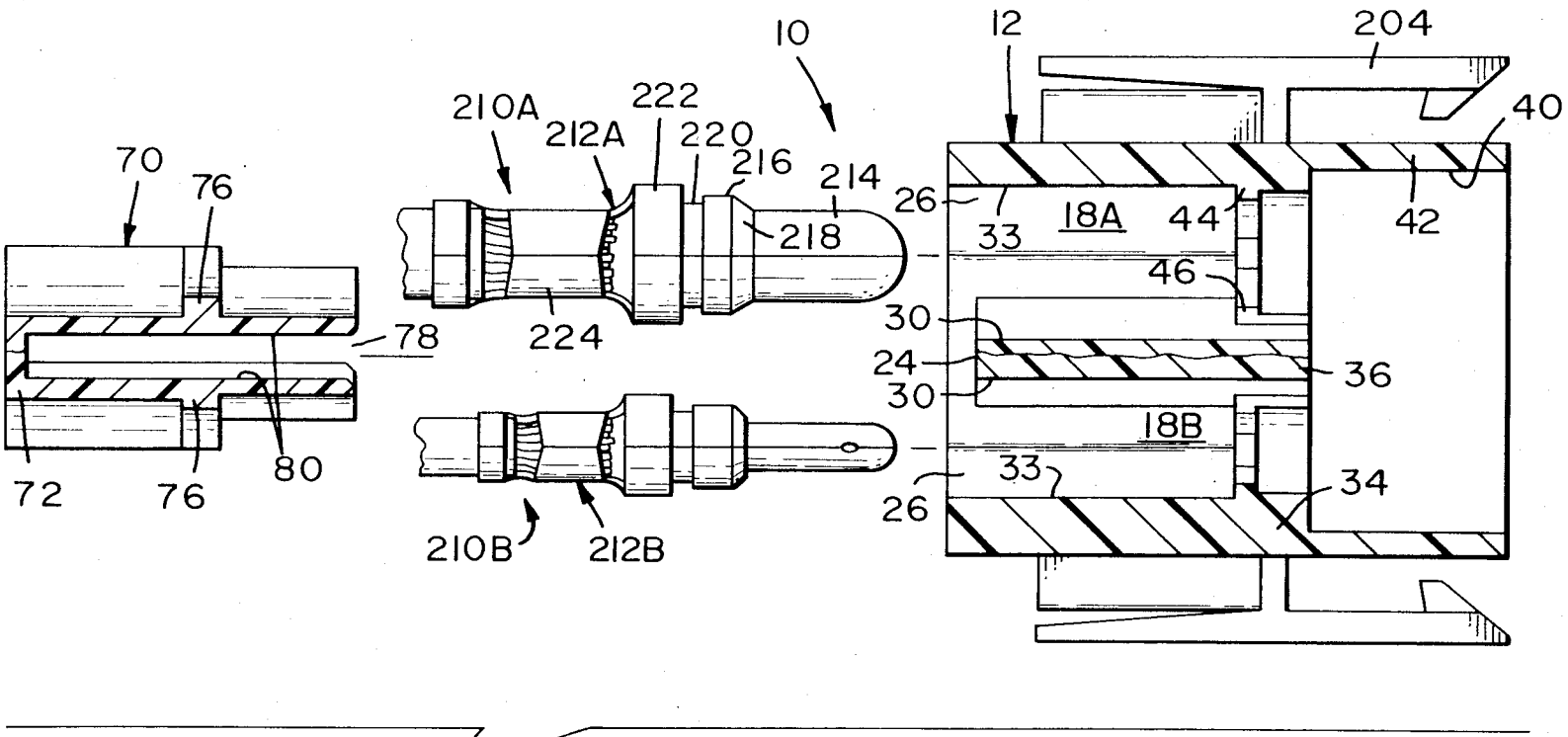
FIG. 4 is a longitudinal section view of the pin terminal connector of FIG. 1 taken along line 4—4.

FIG. 3 comprises a rear perspective view of housing 12 and a front perspective view of locking insert 70. Rearward housing section 16 is identical to rearward housing section 116 and can best be described as having a large cavity having a lateral wall 24 extending from side-to-side between the two rows of cavities 18 forming upper and lower laterally extending insert-receiving cavities 26. Axial channels 28 extend along upper and lower surfaces 30 of lateral wall 24 forming part-cylindrical walls of cavities 18; similarly, axial channels 32 extend along opposing surfaces 33 of upper and lower insert-receiving cavities 26 opposed from upper and lower wall surfaces 30, forming part-cylindrical walls of cavities 18 paired with channels 28. Associated pairs of axial channels 28, 32 serve to guide terminated conductors therealong upon insertion thereof into housing 12. Referring to FIGS. 3 and 4, upper and lower lateral insert-receiving cavities 26 extend forwardly to a transverse partition section 34 of housing 12 between forward and rearward housing sections 14, 16.

Locking insert member 70 in FIGS. 3 and 4 has a transverse end section 72 with opposed top and bottom edges 74 forwardly from which extend wave-like side sections 76 defining a large slot 78 between their inside surfaces 80. Inside surfaces 80 are configured to conform with channeled upper and lower surfaces 30 of lateral wall 24 so that locking insert member 70 is insertable into rearward housing section 16 with side sections 76 movable into upper and lower lateral insert-receiving cavities 26 and lateral wall 24 is now disposed in slot 78. Outer or terminal-proximate surfaces 82 of side sections 76 have axial channels 84 extending therealong opposed from and paired with opposing surface channels 32. Along each axial channel 84 is preselected distance forwardly of transverse end section 72 are locking shoulders 86 which will eventually be disposed against rearwardly-facing stop shoulders of terminals 212 to prevent axially rearward movement of terminals 212 when the terminated conductors have been inserted and properly secured in cavities 18 and locking insert 70 latchably secured in housing 12. Extending forwardly of locking shoulders are front end sections 88 of side sections 76. Inner surfaces 80 may be beveled at forward ends 88 to assist in the initial insertion of locking insert member 70 at lateral wall 24. Front end sections 88 may preferably extend beyond the ends of upper and lower insert-receiving cavities 26 through openings in partition section 34 and extend partially along interior walls of terminal-receiving cavities 18 forwardly of partition section 34 still adjacent to forward portions 36 of lateral wall 24, for reasons which will be explained below. It can be seen that lateral wall 24 will act as a wedge to keep apart front end sections 88 of side sections 76 of locking insert member 70.

Locking insert member 70 preferably has latch projections 90 laterally thereof which are received in cooperating recesses 38 on sides of housing 12 to firmly latch locking insert member 70 within housing 12, but which can be unlatched when desired (such as by a tool means, not shown) to permit removal of locking insert member 70 which then permits removal of one or more terminated conductors 210 from connector 10.

Referring to FIG. 4, large and small terminated conductors 210A and 210B have large and small pin terminals 212A and 212B respectively terminated thereto and are positioned to be inserted into respectively sized terminal-receiving cavities 18A and 18B of housing 12. Each pin terminal has a pin contact section 214, a forward annular stop shoulder 216 having a forwardly facing annular beveled surface 218, an annular latching recess 220, a rear annular stop shoulder 222 which is larger in diameter than forward stop shoulder 216 (and is the largest diameter portion of the terminal), and a conductor-receiving section 224 crimped to a stripped end of a respective conductor. Upon insertion of a terminated conductor 210A or 210B into a resepctive cavity, the respective pin contact section 214 will pass beyond housing partition section 34 and into large forward cavity 40 formed by hood 42 of pin connector housing 12. Annular beveled surface 218 will engage outer latching means 44 and inner latching means 46 simultaneously, and latching means 44, 46 will ride over forward stop shoulder 216 and enter into latching recess 220 latchingly securing the terminal in position. Locking insert member 70 will then be inserted into rear housing section 16 and be latchingly secured therein with locking shoulders 86 so positioned on locking insert member 70 to firmly engage behind rear stop shoulders 222 of the terminals. Assembled connector 10 is then insertable into latching shell member 202 and securable therein.

Figure 5:
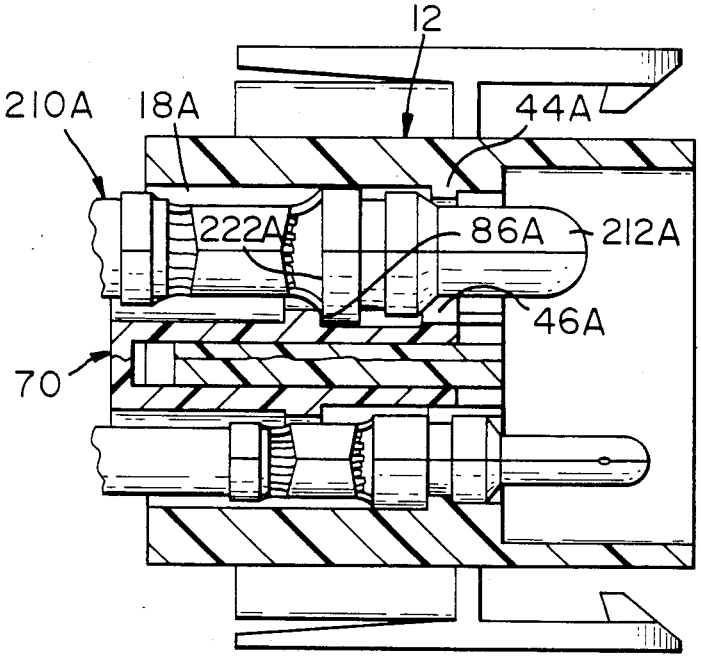
FIG. 5 is a longitudinal section view of the pin terminal connector of FIG. 4 after partial assembly.

FIG. 5 demonstrates an important capability of the particular embodiment of locking insert member 70 described above which is that of terminal position assurance. If a teminated conductor, such as conductor 210A, has not been fully inserted into its respective cavity 18A to be latchingly secured therein, when locking insert member 70 is being inserted into housing 12 a respective locking shoulder 86A will first engage large diameter rear stop shoulder 222A. Continued insertion of locking insert member 70 will urge termial 212A forwardly until it is properly positioned fully latched by latching means 44A, 46A in latching recess 220A, and locking insert member 70 is latched in housing 12.

Figure 6:
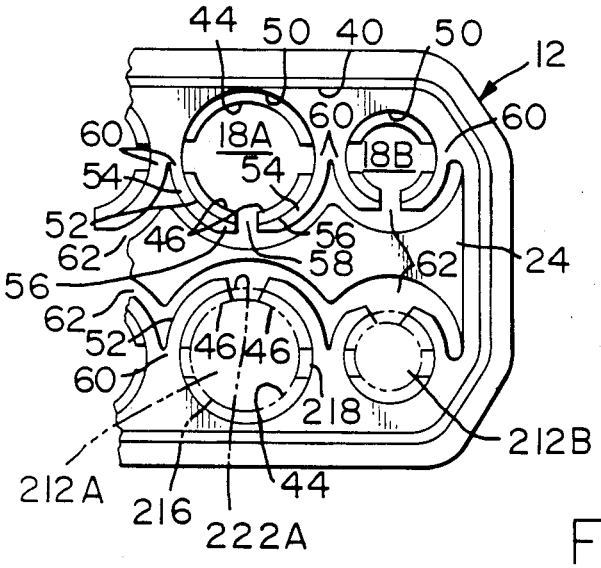
FIG. 6 is a part front view of a housing illustrating the terminal latching means of the housing, and a terminal (in phantom) being inserted into one cavity.

FIG. 6 illustrates the particularly preferred embodiment of the means for latching a terminal of a terminated conductor into a terminal-receiving cavity, which is disclosed in U.S. patent application Ser. No. 599,092 filed Apr. 11, 1984 and assigned to the assignee hereof. Each cavity has a forward section including at least the latching means whether it be a cavity 18 in housing 12 to receive a pin terminal 212 or a cavity 118 to receive a socket terminal 232. Socket-receiving cavity 118 may have a forward section 148 which extends to the front surface 122 of socket connector housing 112 which serves to protect socket contact sections 234 of socket terminals 232 therein, as shown best in FIGS. 7 and 8.

Referring to FIG. 6, forward section 48 of each terminal-receiving cavity 18A, 18B has rigid wall portion 50 and an expandable wall portion 52. Rigid wall portion 50 consists of a semicircular channel in forward section 14 of housing 12, shown in this embodiment as the outer wall of housing 12 but which need not be an outer housing wall in order to practice the present invention. Extending inward from outer rigid wall portion 50 and continuing the circular shape of the cavity cross section is the inner expandable wall portion 52, preferably comprised of arcuate arm-like wall sections 54. The arm-like wall sections 42 have free ends 56 which meet or almost meet at separation or gap 58, and have a thickness and are of such material to have enough resilience to be expanded apart when a terminal 212A, 212B is being inserted, but have enough strength to return to their unexpected condition when the terminal has been fully inserted and latching ledges 44 and 46 have latched into annular latching recess 220 on the terminal. Arm-like wall sections 54 are preferably joined internally with rigid wall portion 50 longitudinally therealong at hinges 60 but are not joined to partition section 34 of housing 12 or any other portion, and thus are free to be radially expanded into an opening means such as intercavity opening 62 preferably in communication with lateral insert-receiving cavities 26 in rearward housing section 16 and forward cavity 40.

Latching means 44 and 46 preferably comprise ridge or ledge sections extending circumferentailly around forward cavity section 48 in the same transverse plane and are dimensioned to fit into annular latching recess 220 of a respective terminal 212. Latching ledge 46 is disposed on each arm-like wall section 54 and comprises two portions separated by gap 58 at free ends 56.

FIG. 6 illustrates the nature of the expandable wall portions in operation. As a terminal 212A or 212B (shown in phantom) is being inserted into its respective cavity 18A, 18B, annular beveled surface 218 facing forwardly from forward stop shoulder 216 engages latching ledges 44, 46. Latching ledge 44 on rigid wall portion 50 urges termnal 212A, 212B laterally away and against latching ledge portions 46 on arm-like wall sections 54. Thus urged, arm-like wall sections 54 expand radially outwardly, being joined to rigid wall portion 50 at hinges 60, and into intercavity opening 62. When forward stop shoulder 216 is moved forwardly, latching ledges 44, 46 enter latchingly into annular latching recess 220 and arm-like wall sections 54 return to their unexpanded position. Larger rearward stop shoulder 222 will not tend to ride over latching ledges 44, 46 because stop shoulder 222 has not beveled forwardly facing surface and latching ledges 44, 46 have no rearwardly facing beveled surface.

Referring back to FIGS. 4 and 5, preferred locking insert member 70 has front end section 88 which will be disposed adjacent preferably flat outer surfaces 64 of arm-like wall sections 54 when locking insert member 70 is fully inserted. To allow for insert member 70 to function as a means of fully inserting a terminal, front end sections 88 must not be so snug against outer surfaces 64 of arm-like wall sections 54 as to prevent them from expanding to seat the terminal. But front end sections 88 can serve to prevent the much greater expansion of arm-like wall sections 54 by larger diameter terminal stop shoulders 222 in the unlikely event that terminal 212 would be urged forwardly under significant force.

Figure 7:
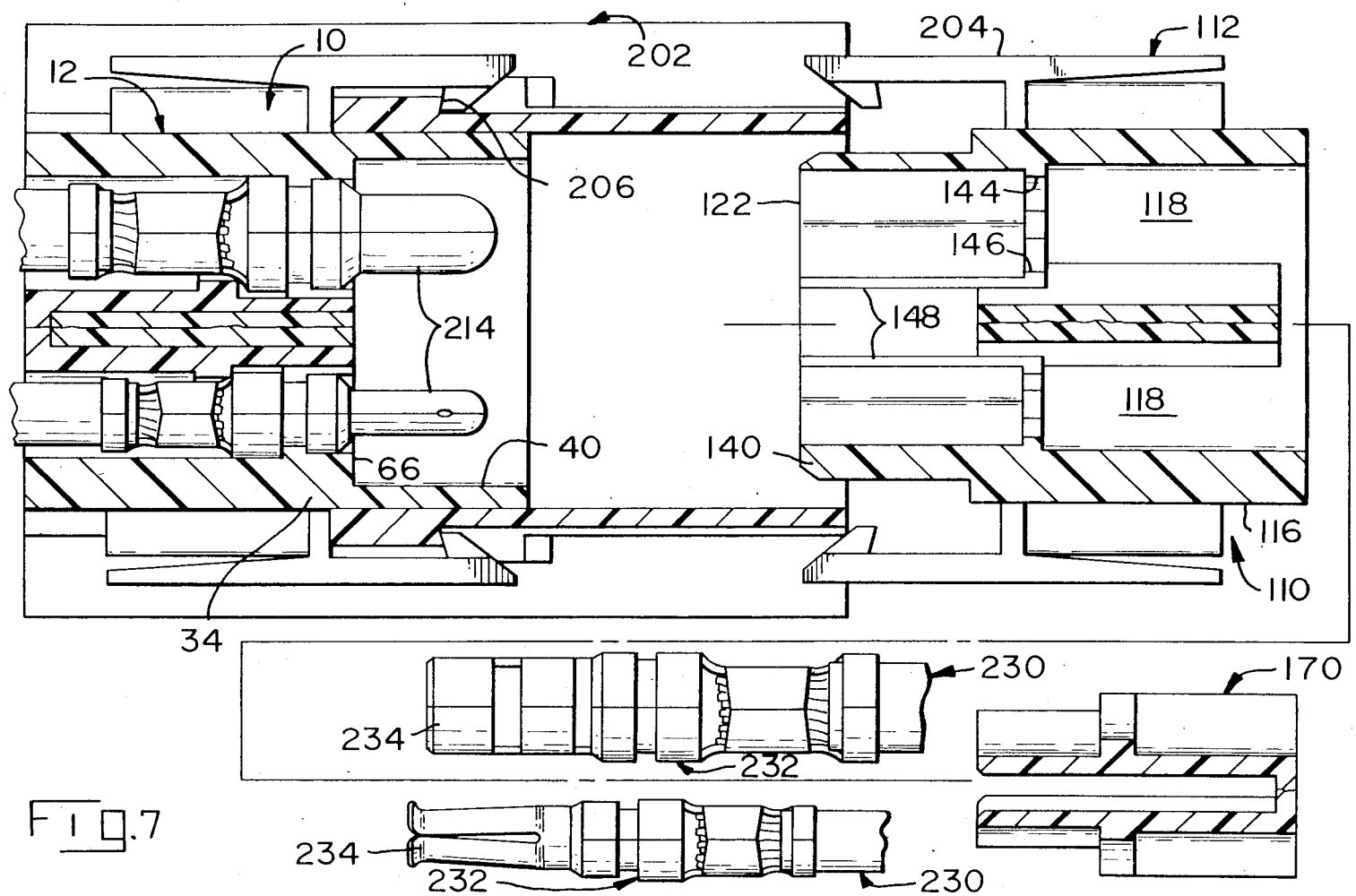
FIG. 7 is a longitudinal section view of the assembly of FIG. 2 with the socket terminal connector, terminals and locking insert exploded therefrom.
Figure 8:
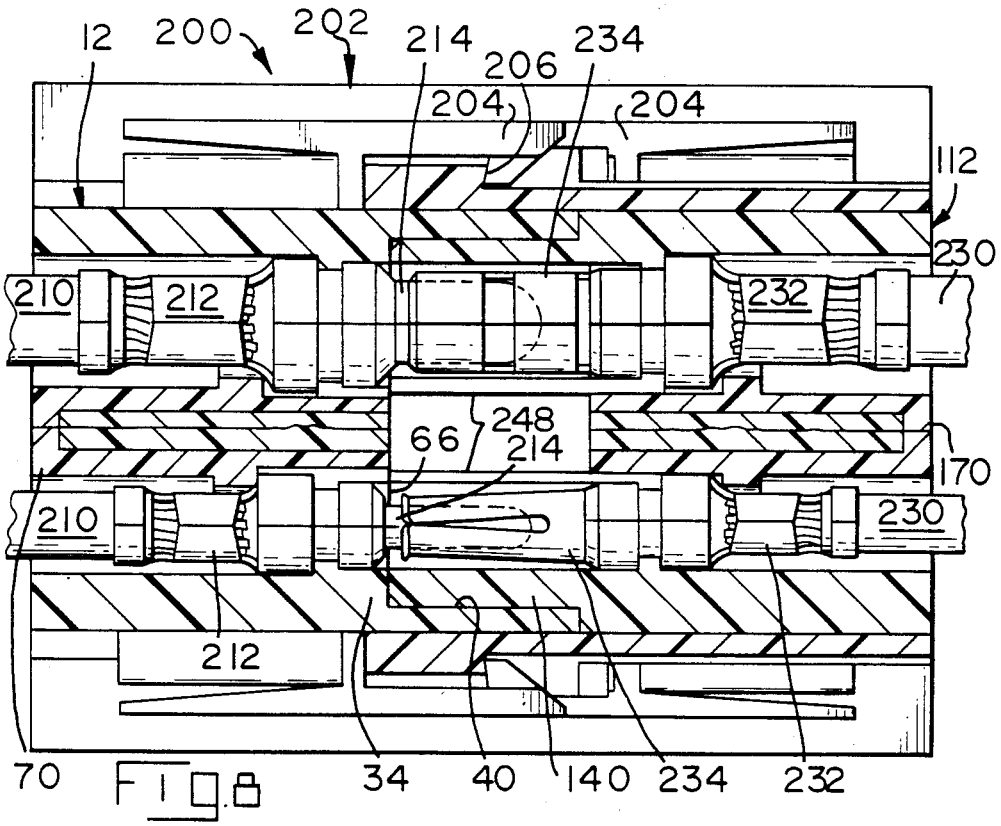
FIG. 8 is a longitudinal section view of the assembly of FIG. 2 taken through line 8—8 thereof.

FIGS. 7 and 8 show socket connector 110 to be assembled and inserted into latching shell member 202, which already contains pin connector assembly 10. Conductors 230 have socket termials 232 terminated thereto which are inserted into rearward housing section 116 (identical to rearward pin connector housing section 16), into cavities 118 and are latched therein by latching ledges 144, 146. Locking insert member 170 is identical to locking insert member 70 and is then latchingly secured in rearward housing section 116. Forward cavity sections 148 extend to front surface 122 of housing 110 to protect socket contact sections 234. Forward socket connector housing section 140 is reduced in its outer dimension from the remainder of the housing to a dimension allowing forward section 140 to fit within forward cavity 40 of pin connector housing 12 and abuts (or almost abuts) against the forward surface 66 of partition section 34 of housing 12, at which time pin contact sections 214 will be engaged within socket contact sections 234, when assembled socket connector 110 is latchingly secured in latching shell member 202, as shown in FIG. 8.

An alternate embodiment of locking insert member (not shown) is similar in overall structure to locking insert member 70 except that it has thicker front ends. Thicker front end sections would snugly fit against the outer surfaces of the expandable wall portions of the terminal-receiving cavities of a housing and thereby prevent the exapandable wall portions from expanding. Thicker front end sections are prevented from being urged toward each other by reason of the lateral wall fitting snugly between the side sections of the locking insert member. Such a locking insert member would not be usable to seat partially inserted terminals, and seating thereof would be accomplished by conventional methods prior to full insertion of the locking insert member. However, such an insert member could serve as an indicator that at least one terminal is not fully seated, and all terminals could be rechecked for proper seating.

A locking insert member such as member 70 or the alternate described above, with minor modifications, could be used with other types of terminal-latching mechanisms in the same manner, by preventing expansion for instance of the cantilevered locking member of U.S. Pat. No. 3,937,545 discussed herein, provided that opening means adjacent the locking member is in axial communication with lateral insert-receiving cavities in the rearward housing section.

It is possible to utilize several locking insert members of the present invention to be placed between respective pairs of cavity rows of a multirow housing. It is also possible to utilize the locking insert with a connector having different sized cavities in the same row, as shown in FIG. 6, if the insert member appropriately conforms to the configuration of the lateral wall. In any of the embodiments, the housings may be selectively loaded if desired; that is, not all of the cavities need have terminals therein in order to utilize a locking insert member of the present invention.

The present embodiments may be subject to many modifications and changes without departing from the spirit or essential characteristics of the present invention and are therefore to be considered in all respects as illustrative and not restrictive of the scope of the invention.

What is claimed is:

1. An insert for an electrical connector, said connector having a dielectric housing, at least one terminal-receiving cavity extending axially therethrough and a respective terminal disposed therein, each said respective terminal terminated onto an associated electrical conductor, comprising:

a dielectric body means profiled to be axially received alongside rearward conductor portions in an insert-receiving cavity means in a rearward section of said housing from rearwardly thereof;

means laterally of said body means for securing said body means in said insert-receiving cavity means; and terminal-engaging stop means on said body means extending outwardly from terminal-proximate surface means thereof for engaging each said terminal rearwardly of a cooperating stop means thereof such that when said body means is secured in said housing, said terminal-engaging means prevent axially rearward movement of each said terminal.

2. An insert as set forth in claim 1 wherein said terminal-engaging stop means are stop shoulder portions engageable with a respective cooperating stop shoulder on each said terminal.

3. An insert as set forth in claim 1 wherein said securing means comprises latching means on said body means latchably engageable with cooperating latching means on said housing.

4. An insert as set forth in claim 1 wherein said connector has a plurality of said terminals terminated to respective said conductors and disposed in rows of said terminal-receiving cavities, said insert-receiving cavity means comprising laterally extending insert-receiving cavities each in communication with said terminal-receiving cavities in a respective said row, and said housing has a lateral wall section between adjacent ones of said insert-receiving cavities, said lateral wall section having upper and lower surfaces and a rear surface, said body means further comprising a transverse section and parallel side sections extending forwardly therefrom on which are disposed said terminal-proximate surface means, and upon insertion into said housing said side sections extend along respective said upper and lower surfaces of said lateral wall section in an associated said insert-receiving cavity and alongside respective said rearward conductor portions, said terminal-engaging stop means being disposed proximate forward ends of said side sections of said body means, said transverse section being disposed proximate said rear surface of said lateral wall section.

5. An insert as set forth in claim 4 wherein said side sections have part-cylindrical channels extending axially along said terminal-proximate surface means thereof adjacent respective said rearward conductor portions upon insertion into said housing.

6. An insert as set forth in claim 5 wherein said terminal-engaging stop means are arcuate stop shoulder portions proximate forward ends of said part-cylindrical channels, engageable with respective cooperating stop shoulders on said terminals therebehind.

7. An insert as set forth in claim 5 wherein said securing means comprises latching means on said transverse section latchably engageable with said housing.

8. An insert as set forth in claim 5 wherein said side sections have front end sections forwardly of said stop means and disposed adjacent terminal-securing means of respective said terminal-receiving cavities upon insertion of said body section into said housing.

9. An electrical connector assembly comprising:

a dielectric housing;

at least one terminal terminated to an electrical conductor disposed in a respective terminal-receiving cavity extending axially through said housing; and a dielectric insert member profiled to be axially received in an insert-receiving cavity means in a rearward section of said housing from rearwardly thereof alongside a rearward portion of said at least one conductor, there being means on one of said insert member and said housing for securing said insert member in said insert-receiving cavity means, said insert member having terminal-engaging stop means thereon for engaging each said terminal rearwardly thereof such that when said insert member is secured in said housing, said stop means prevent axially rearward movement of each said terminal.

10. An electrical connector assembly as set forth in claim 9 wherein a plurality of said terminals are disposed in rows of said terminal-receiving cavities, said inset-receiving cavity means comprising laterally extending insert-receiving cavities each in communication with said terminal-receiving cavities in a respective said row, said housing has a lateral wall section between adjacent ones of said insert-receiving cavities, said lateral wall section having upper and lower surfaces and a rear surface, and said insert member comprises a transverse section and parallel side sections extending forwardly therefrom and upon insertion into said housing said side sections extend along respective said upper and lower surfaces of said lateral wall section in an associated insert-receiving cavity and alongside respective said rearward conductor portions, said terminal-engaging stop means being disposed proximate forward ends of said side sections of said insert member, said transverse section being disposed proximate said rear surface of said lateral wall section.

11. An electrical connector assembly as set forth in claim 10 wherein said side sections have front end sections forwardly of said stop means and disposed adjacent terminal-securing means of respective said terminal-receiving cavities upon insertion of said insert member into said housing.

12. An electrical connector assembly as set forth in claim 10 wherein said securing means comprises latching means on said transverse section latchably engageable with cooperating latching means on said housing.

13. An electrical connector assembly as set forth in claim 12 wherein said latching means are capable of being unlatched from said housing.

14. An electrical connector assembly as set forth in claim 10 wherein said side sections have part-cylindrical channels extending axially along terminal-proximate surfaces thereof adjacent respective said rearward conductor portions upon insertion of said insert member into said housing.

15. An electrical connector assembly as set forth in claim 14 wherein said terminal-engaging stop means are arcuate stop shoulder portions proximate forward ends of said part-cylindrical channels, engageable with respective cooperating stop shoulders on said terminals therebehind.

16. An electrical connector assembly as set forth in claim 14 wherein a wall means of said housing defines an opposing surface parallel to a respective side of each said lateral wall section and has part-cylindrical channels extending axially therealong adjacent respective said rearward conductor portions, and each of said opposing surface channels cooperate with a corresponding one of said channels of said insert member side sections upon insertion of said insert member into said housing to substantially surround a respective rearward conductor portion therealong.

17. An electrical connector assembly as set forth in claim 16 wherein each said side of said lateral wall section has part-cylindrical channels extending axially therealong each opposed to a respective said channel along said opposing surface to receive a respective rearward conductor portion therealong, and said side sections of said insert member have inside surfaces proximate respective said upper and lower surfaces of said lateral wall section which are profiled to correspond thereto to permit axial movement of said side sections of said insert member along said upper and lower surfaces of said lateral wall section of said housing during insertion and removal of said insert member.

* * * * *